United States Patent [19]

Rumez

[11] Patent Number: 4,834,120

[45] Date of Patent: May 30, 1989

[54] HAIR COSMETIC TREATMENT APPARATUS

[76] Inventor: Walter Rumez, Breslauer Str. 37, D-7518 Bretten, Fed. Rep. of Germany

[21] Appl. No.: 67,006

[22] Filed: Jun. 29, 1987

[30] Foreign Application Priority Data

Jun. 27, 1986 [DE] Fed. Rep. of Germany ..... 3621654

[51] Int. Cl.[4] ..... A45D 2/12

[52] U.S. Cl. ..... 132/228; 132/202; 132/227

[58] Field of Search ..... 132/7, 33 G, 33 R, 37 R, 132/39, 41 A, 41 B, 202, 207, 208, 209, 227, 228

[56] References Cited

U.S. PATENT DOCUMENTS 4,526,184 7/1985 Caruso ..... 132/33 G
4,632,133 12/1986 Losenno ..... 132/33 G
4,638,821 1/1987 Smith ..... 132/7

*Primary Examiner*—Stephen F. Husar

*Attorney, Agent, or Firm*—Antonelli, Terry & Wands

[57] ABSTRACT

A hair cosmetic treatment apparatus has a curler with a body for curling the hair and a jacket which can be mounted thereon, embraces the curl and leaves a gap between it and the body. The jacket comprises semicylindrical shells provided on their longitudinal edges with seals and which can be brought into a closed position by means of clamping devices which can be mounted on both end faces. The jacket has radial hose nipples, which are connected by means of transverse ducts in the body to the gap. To the hose nipples can be connected hoselines, by means of which liquid treatment medium can be supplied to the curler and passed through the same. For hermetic sealing purposes, the longitudinal edges of the half-shells are provided with seals, which are additionally coated with a hydrophobic sealing compound. The successively or parallel-connected curlers are connected to a supply and control apparatus with processor, which contains the treatment medium in storage containers and supplies same by means of pumps to the hoselines and curlers.

25 Claims, 2 Drawing Sheets

HAIR COSMETIC TREATMENT APPARATUS

BACKGROUND OF THE INVENTION

The present invention relates to an apparatus for hair cosmetic treatment, particularly for producing permanent waves, with at least one curler having a substantially rotationally symmetrical body for curling the hair, a jacket which can be placed on the body, embraces the curl and forms a gap between it and the body, said jacket being formed from two part cylindrical shells, which are provided with at least two contiguous longitudinal edges with seals and are held by means of spring tension in a closed position engaging the body, the jacket having an opening for the supply of liquid hair treatment agents and the body has transverse ducts for introducing said agents into the curl.

Permanent waves are produced by curlers, which comprise a generally cylindrical, centrally constricted curling part made from plastic with shaped elements, which increase the surface of the curler, so that the hair applied to the latter is relatively firmly entwined by it, but is held in loosened form in order to ensure a good wetting of the hair with the perming solution, as well as a good penetration of the hair during rinsing. Following the curling of the hair onto the curler, the hair is secured with a rubber strip tensioned along the curler over its facing end faces and optionally rods are drawn under the rubber strip.

A brush or sponge is then used for dabbing the perming solution onto the individual curls until an adequate wetting of the hair has been achieved. At the end of the necessary action time, intermediate rinsing takes place with water, optionally accompanied by a neutralization check with an indicator or reaction paper. Finally, to fix the shape given by the curler under the action of the perming solution, a fixing solution is dabbed in the same way onto the curls and subsequently rinsed out of the curled hair again. This is followed by the removal of the curler, after which fixing may be repeated and finally the hair is coiffured.

The durability and dimensional stability of the permanent wave or perm can be increased if the action on both the perming solution and the fixing solution takes place under heat treatment, i.e. under a dryer.

However, these applications are very complicated and require a considerable amount of time, the results being essentially dependent on the skill of the hairdresser during the dosing and distributing of the perming and fixing solutions. Another problem when producing permanent waves is that the perming solution can lead to irritations or allergic reactions both on the scalp of the customer and on the hands of the hairdresser.

An apparatus is known (French Pat. No. 1 002 340), which attempts to solve these problems. The aforementioned apparatus in the form of a curler comprises a body receiving the hair and a jacket formed from two shells co-operating in clamp or clip-like manner. The two shells can be opened counter to a spring tension formed by a spring clip surrounding the common pivot axis of the two shells and can be moved over the body. The two shells are constructed as semicylinders in the vicinity of their ends to permit the operation thereof. Opposite to the longitudinal edges with the seals, pressure plates are shaped onto the semicylindrical parts, much as in the case of a clothes peg and can be compressed by finger pressure in opposition to the spring tension. Over most of their axial extension, the shells are constructed as quarter-cylinders, so that in the closed position they form an upwardly open half-shell. The perming solution is introduced from this side into the half-shell and an outflow onto the scalp is prevented by the seals on the lower longitudinal edges of the quarter-shells. The perming solution impregnates the curls and can also flow through the transverse ducts of the curling part. A good sealing on the longitudinal edges can only be achieved if the sealing surfaces of the shells are pressed against one another by a very high spring tension. As a result the shells can only be opened through considerable exertion or not at all and this cannot be expected of the generally female hair dresser. In addition, the perming solution can frontally run out, because no separate seals are provided there. In addition, this curler suffers from the serious disadvantage that it can only be applied to the top of the head due to the top-open construction, because otherwise the perming solution would run out. Following treatment, the curler must be emptied, which is only possible through opening the shells, so that the scalp and customer is general are in no way given protection by this method. A precise dosing of the perming solution is not possible. Overdosing and unnecessary consumption must be expected if, in place of the conventional dabbing of the curl, the perming solution is now filled into the half-shell.

Another known apparatus (German Pat. No. 589 286) is used following onto the conventional application of the perming solution. It is used for heating the curler, the main shaping of the hair taking place by heat supply using steam. Hereagain a curling part is provided, which is completely embraced by a two-shell jacket. The curling part has axial hose nipples for the connection of hoselines for steam treatment. The steam flows through the hollow curler in the axial direction. Near to the front faces, the curling part has transverse ducts, through which the steam can advance into the cavity between it and the jacket and consequently to the curl. The half-shells are interconnected in hinge-like manner and are provided with a closure on the under side thereof facing the scalp. Both the opening and closing of the curl must consequently take place in the immediate vicinity of the scalp, which is very complicated because the closure or fastener is subject to difficult access conditions. The mounting and removal of the hoselines or connecting lines between the individual curlers is also complicated, because this operation takes place in the axial direction and therefore close to and parallel to the scalp. Although the jacket is admittedly axially sealed with respect to the curling part by ring seals, it is not sealed radially between the two half-shells. Thus, this curler does not solve the aforementioned problems both for the customer and the hairdresser when applying the perming solution.

The problem of the present invention is to so further develop an apparatus of the aforementioned type, that the curler can be fitted simply and in problem-free manner to the head of the customer, a high sealing effect against running out of the treatment solution is ensured and a completely satisfactory dosing of said solution is possible.

SUMMARY OF THE INVENTION

According to the invention this problem is solved in that the jacket is formed from two semicylindrical shells completely surrounding the body, having on one end face a radially oriented feed opening, on the other end face a radially oriented discharge opening with in each case one line connection and on both end faces, outside the feed and discharge openings, engage on the body, wherein each case one transverse duct is connected in the body to the feed and discharge opening and wherein, at least on their longitudinal edges with the seals, the shells can be additionally sealed by an applicable sealing compound.

A complete sealing or termination of the curl is obtained through the semicylindrical shells with the ring seals or sealing rings and the seals on the longitudinal edges of the half-shells. As a result of the radial configuration of the line connections on the sides facing the longitudinal edges with the seals, it is readily possible to mount the hoselines in a position at right angles to the scalp and remove same in the same way. By means of the hoselines, the treatment solution can be supplied and removed in a constant flow, namely in the extent necessary for producing a satisfactory perm, i.e. in precisely dosed form, without the perming solution being able to escape at the end faces or on the longitudinal edges of the jacket. This is in particular prevented in that at least on the seals on the longitudinal edges a sealing compound is applied. It has been found that e.g. perming solution is able to migrate through the smallest cracks due to its very low surface tension, so that it can in particular penetrate to the outside through the curls secured between the seals. This is effectively prevented by the sealing compound, which also penetrates into the start of the curl. Thus, the scalp of the customer is reliably protected from any access of treatment solution. This also applies to the hairdresser, because the treatment solution is fed from a central point, via hoselines into the curler and can be removed again at the end of the flow path. The individual curlers are advantageously connected in series, so that only a single feed and a single discharge are necessary.

According to an advantageous embodiment a further sealing ring is provided within the supply opening and discharge opening on both end faces and the transverse ducts issue on the one hand into the space between the sealing rings and on the other into the space between the jacket and the body. As a result of this double sealing ring, there is a further improvement to the sealing on the end faces and the escape of treatment solution thereat is effectively prevented, whilst still ensuring a supply of treatment solution to the curl in the space.

According to another feature the invention comprises a U-shaped clamping device producing the spring tension and constituted by two parallel legs interconnected by means of a bend, curve or camber, the latter being constructed as a receptacle partly engaging round the ends of the half-shells and the free ends of the parallel legs are moveable in a direction towards one another and can be resiliently locked together.

The inventive construction of the clamping device has the advantage that on the one hand the half-shells are effectively pressed against one another and consequently the curl is encapsulated in liquid-tight manner and on the other the clamping device can be easily operated by spring pressure through the legs, which form a long lever arm until the legs have locked. For applying the necessary pressure for sealing the half-shells located within the curve of the clamping device, it is only necessary to expend a relatively limited force. In order to prevent slipping of the half-shells within the clamping device, the bend or curve is constructed in such a way that it engages round the half-shells with an angle of more than 180° C.

According to a preferred embodiment, the free ends of the parallel legs of the clamping device are bent towards one another and the bent portions overlap and have a tooth system, enabling them to be locked against one another, the tooth system being e.g. constructed as a sawtooth system. After engaging the clamping device on the half-shells of the jacket, the free ends of the parallel legs are moved towards one another, the overlapping portions locking together with their tooth system. This can take place by means of two fingers, because only a limited pressure is required. The tooth system ensures a reliable locking of the two legs and therefore a constant pressure on the jacket half-shells located in the receptacle. The clamping device can easily be opened in that the bent portions of the legs are moved at right angles to the locking direction, so that there is disengagement of the tooth system. Once again only a limited force is required, which can be readily applied by two fingers.

It is advantageous to provide a clamping device on each of the ends of the two half-shells. The clamping devices can be simply mounted on the ends of the half-shells and the latter are closed in liquid-tight manner by locking the clamping device legs.

In order to obtain a very high pressure in the receptacle of the clamping device on the half-shells, the clamping devices are arranged in such a way that the parting or separating plane of the half-shells is oriented substantially parallel to the clamping device legs. In this arrangement the clamping device can be very easily operated, because the legs project vertically from the head surface.

According to another embodiment, a liquid-tight closure of the half-shells can be achieved in that the clamping device legs are shaped onto the ends of the half-shells and the half-shells can be hooked together on the side facing the legs. The shaping of the legs on the ends of the half-shells has the advantage that there is no longer any need to mount the clamping device and instead the two half-shells with their lower end only have to be hooked together and locked with the shaped on legs, so that the working time for applying a curler is reduced.

According to a preferred embodiment the body and the jacket have in the vicinity of their end faces, a conically tapering and then an external cylindrical portion, which serves as a seat for the clamping device with respect to the jacket. As a result of the conical construction of one portion, it is advantageously possible to centre the two jacket half-shells to be fitted to the body, so that following fitting they no longer need to be aligned and instead it is only necessary to mount the clamping devices. The supply and discharge openings are advantageously formed by hose nipples radially fitted to the jacket.

Through the construction of the jacket with radially positioned hose nipples, the advantage is obtained that the curlers can be fitted in both juxtoposed and successive manner on the head of the customer without any disturbing gap. By means of the radially projecting hose nipples, they can easily be connected together by means of hoselines.

Advantageously the supply and discharge openings for the liquid hair treatment agent are provided in the vicinity of the conically tapering portions on the jacket.

As these portions are located in the end regions of the curler, the gap located between them and which receives the curl is completely through-flowed by the hair treatment solution and consequently the curl is completely wetted by the liquid. The ducts in the body also permit an easy removal of the air bubbles located in the gap, so that they cannot become fixed between the body and the jacket or on the curl.

According to a preferred embodiment, these air bubbles are removed in a completely satisfactory manner in that the body is provided externally and/or the jacket internally with longitudinal and/or transverse grooves. Although these grooves have a limited depth, they make it possible to ensure that the air bubbles are not stopped by the hair and the capillaries between them, instead being removed via the grooves. This ensures a complete access of the solution to the hair. An improved sealing action is achieved in that in the vicinity of the longitudinal edges the shells are given a greater wall thickness, so that the half-shells have a larger bearing surface.

A further enlargement of the surface is achieved in that the longitudinal edges of the half-shells are inclined by approximately 45° to the diametral plane. The slope of the lower longitudinal edges also has the advantage that their position follows the predetermined position of the curl and consequently the jacket can be more easily fitted. This inventive construction of the longitudinal edge also leads to no kinking of the strand of hair.

A simplification of the curling of the hair onto the body is achieved in that said body is constructed with at least one wing or flap axially arranged on one side and projecting over the jacket. Prior to the locking of the clamping devices applied to the ends of the half-shells, as a result of a limited rotation of the wing or flap the seat of the curl on the body can be checked and optionally corrected.

The sealing compound additionally used for sealing purposes can be applied, e.g. by means of a brush, to the half-shell seals prior to the mounting of the half-shells. Advantageously the sealing compound consists of a waterproof and hydrophobic emulsion, e.g. a water-in-oil emulsion, which can easily be washed out at the time of rinsing. It is also possible to store the sealing compound in chambers within the half-shells, e.g. in the longitudinal edges, so that it is sufficient for several uses.

Advantageously the curlers are interconnected by means of hoselines and high-speed couplings with a supply and control apparatus with microprocessor. By means of the supply and control apparatus, the curlers are centrally supplied with the hair treatment solution and said curlers can be connected both successively and in parallel.

According to a preferred embodiment, the supply and control apparatus is characterised in that pumps for transporting the treatment solution, a mixer for mixing the components of a perming solution and a heating means for heating the solution are provided. In addition, pH-meters, flowmeters, turbidimeters and the like are provided for monitoring or adjusting the mixing ratio of the perming solution components. The perming solution which generally comprises two components is removed by means of pumps from storage containers and supplied to the mixer, whereupon the mixing ratio of the components is checked by means of a pH-meter. However, it is also possible to monitor the mixing ratio by means of flowmeters arranged in the component feed lines, or by means of a turbidimeter, which checks the mixing ratio of the coloured components, which have a characteristic cloudiness after mixing. Following onto the check of the mixing ratio of the components, the liquid is supplied to a heating means, which heats it to the desired temperature. Following the passage through the curler, a further turbidimeter is provided, which makes it possible to establish whether all the curlers are filled with liquid or whether perming solution or some other liquid has to be supplied, so that the supply apparatus can then be switched to circuit operation.

According to a preferred embodiment containers are provided on the supply and control apparatus containing further hair treatment solutions, whilst collecting containers are provided for used treatment solutions or liquids. The supply and control apparatus can be used for both acid and alkaline perms and the curlers can be successively supplied with perming solution, fixing liquid, as well as care lotions or medical rinses.

The pumps of the supply and control apparatus can be advantageously switched to manual operation, so that it is possible to continue to use the apparatus in the case of a power cut, without damaging the customer's hair.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
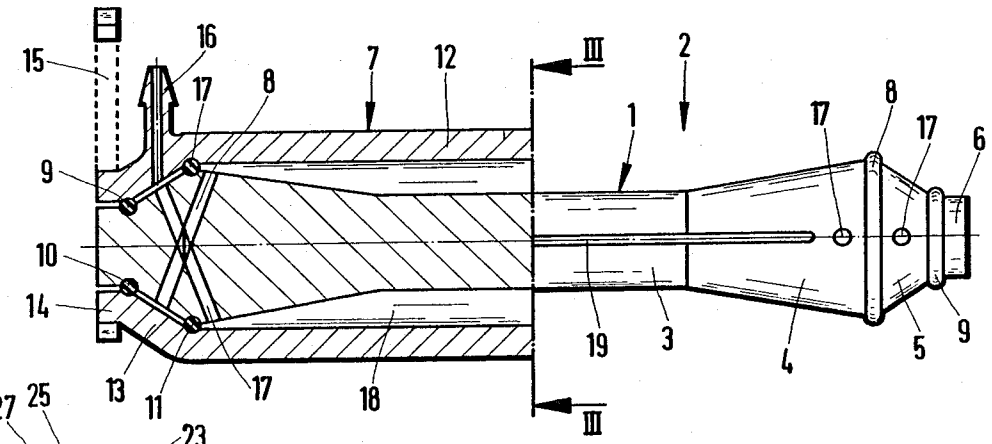
FIG. 1 an axial section through the curler and a side view of the body.

FIG. 1 shows a body 1 of a curler 2, which has a rotationally symmetrical configuration and comprises a curling part 3, as well as on either side thereof conical portions 4 and 5, together with a cylindrical portion 6. Conical portion 5 forms a sealing fit for a jacket 7 surrounding body 1 and for this purpose is provided with sealing rings 8,9, which in this case are constructed as O-rings and are inserted in circumferential grooves 10,11 of conical portion 5. Jacket 7, which surrounds body 1, comprises a cylindrical portion 12, a conically tapering portion 13 following onto it and a cylindrical portion 14, which serves as a seat for a clamping device 15. On the inside, conical portion 13 also has circumferential grooves for sealing rings 8,9. On said outside is provided a radially extending hose nipple 16 as a supply or discharge opening, which issues on the inside of the jacket in the vicinity of conical portion 13. An identical hose nipple is provided on the not shown other end of the jacket. The conical portion 5 of body 1 also has transverse ducts 17, which connect hose nipple 16 with the gap 18 receiving the curl.

Figure 2:
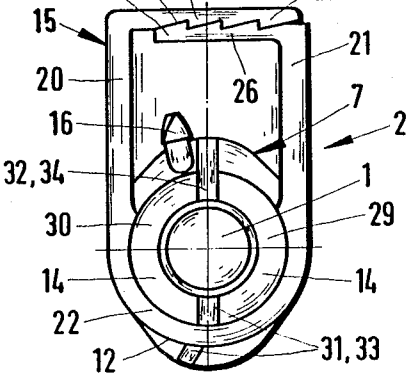
FIG. 2 a front view of a curler in the closed position.

In the view of curler 2 shown in FIG. 2, it is possible to see the clamping device 15 engaged over the cylindrical portion 14 of jacket 7. This clamping device comprises two substantially parallel legs 20,21 and a curve or bend 22 connecting them. The free ends 23,24 of legs 20,21 are bent towards one another and form portions 25,26. In the overlapping region of portions 25,26, the latter are provided with a tooth system 27, e.g. a saw-tooth system enabling them to be locked together. The clamping device 15 is closed by pressure on the upper ends of legs 20,21 in the direction of their bent portions 25,26, so that their teeth 27 engage. A release of the tooth system can be broughtabout in that the portions are displaced transversely (at right angles to the plane of the drawing), so that disengagement of tooth system 27 is achieved. When legs 20,21 of clamping device 15 are locked, the spring tension is transferred via bend 22 constructed as a receptacle 28 for jacket 7 to the two cylindrical portions 14 of half-shells 29,30. On their longitudinal edges 31,32, half-shells 29,30 are provided with seals 33,34, by means of which a liquid-tight encapsulation of body 1 is obtained. Seal 33 is inclined by 45° with respect to the diametral plane in the vicinity of cylindrical portion 12. At the upper end of one half-shell 30 is provided hose nipple 16, which projects radially from the surface thereof.

Figure 3:
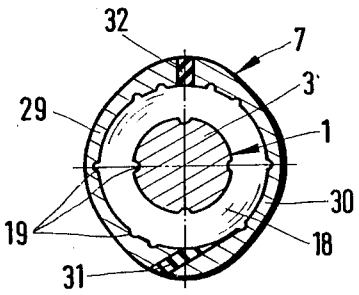
FIG. 3 a section III—III according to FIG. 1

FIG. 3 shows the curling part 3 of body 1, which is surrounded by centrally positioned half-shells 29,30. Winding part 3, as well as the inner surface of jacket 7 has longitudinal grooves 19, which are used for removing air bubbles. It is also possible to see the oval cross-section of the jacket, which leads to small wall thicknesses and wide contact surfaces 31,32. It is also possible to see the enlargement of contact surface 31 through its arrangement under an angle of approximately 45° to the diametral plane. This arrangement of contact surface 31 also facilitates the mounting of the jacket on the curl and prevents kinking on the strand of hair.

Figure 4:
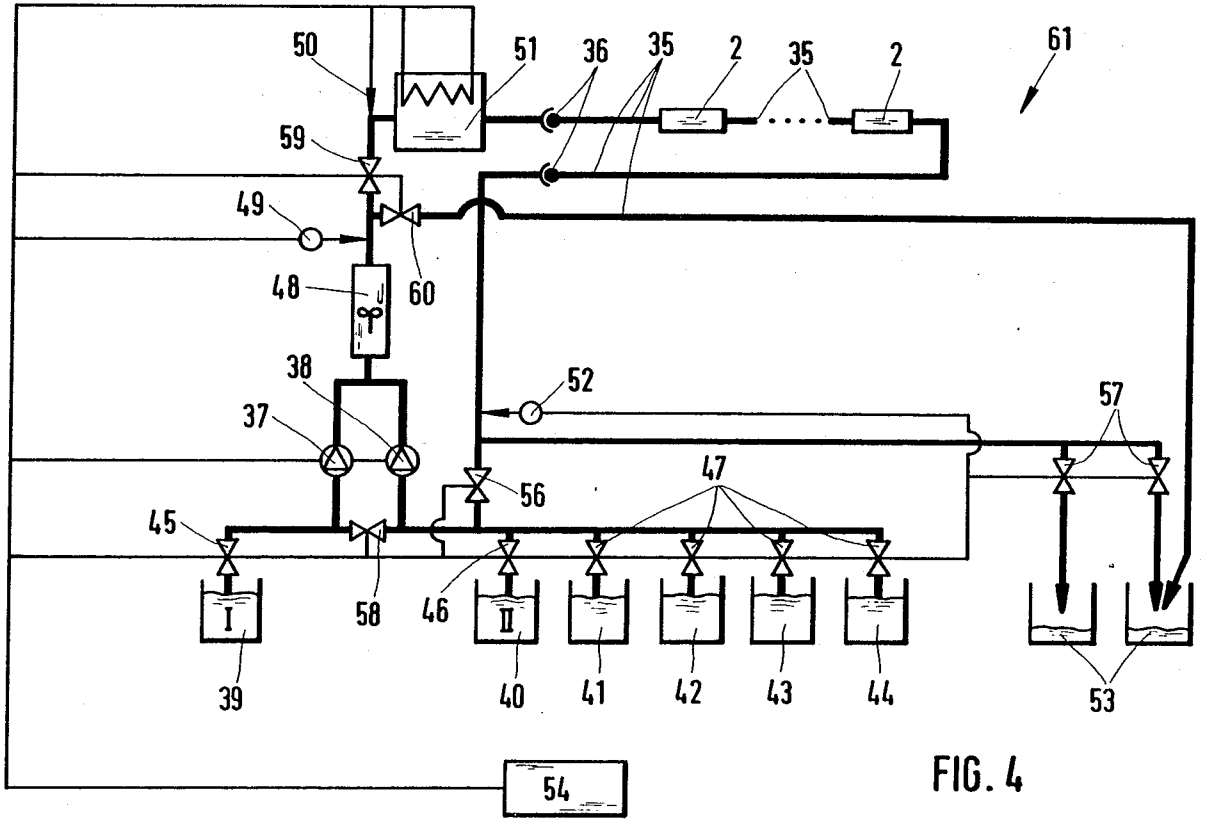
FIG. 4 a flow diagram of the supply and control apparatus.

The flow diagram of the supply and control apparatus shown in FIG. 4 shows several curlers 2, which are connected to one another by hoselines 35, represented by thick lines and to the supply and control apparatus 61 by means of high-speed couplings 36. Curlers 2 are supplied with liquid hair treatment solution via hoselines 35 which has been supplied by pumps 37,38 from containers 39–44. The individual containers are switched on or off by means of electrically controllable solenoid valves 45–47. Behind pumps 37,38, the liquid passes into a mixer 48, which e.g. mixes the components of a perming solution and subsequently into an optometer 49, which determines the cloudiness of the coloured, mixed components. Following optometer 49, the temperature of the solution is determined by means of a thermocouple 50 and correspondingly the solution temperature is raised by a heating means 51. The solution then passes into the curler 2 and then through a further optometer 52, which identifies the change in the cloudiness and consequently the solution used. The solution can be pumped in circuit form and spend or used solution can be collected in containers 53. The supply and control apparatus 61 is regulated by means of a microprocessor 54, which is connected to control elements by electric lines 55, which are shown by the thin lines in the drawing.

The operation of the supply and control apparatus 61 will now be described. Following the application of curler 2 to the hair and after mounting the hoselines 25 on hose nipple 16 and connection by means of the high-speed couplings 36, the supply and control apparatus 61 is put into operation.

The operator or hairdresser firstly feeds in the data concerning the hair to be treated, such as length, thickness, possible colouring, the state of the hair, porous, healthy, etc. into a not shown input unit of the supply and control apparatus 61 and from said data microprocessor 54 calculates the necessary action times and hair treatment solutions. The curlers 2 are then filled with water, which is taken by means of pumps 37,38 from a storage container 44 or the water mains. The solenoid valves of all other storage containers 39–43, as well as valves 56 and 60 are closed, whilst valves 57,58 and 59 are opened. This rinsing with water is used on the one hand for checking the sealing of the connection points of the hoselines 35 to curlers 2 and jacket 7 and on the other hand it rinses out air located in hoselines 35 and curlers 2. The supply and control apparatus 61 is then switched to perming solution, so that the solenoid valve 47 of container 44 and valve 58 close, whilst valves 45 and 46 of containers 39 and 40 for the two components I and II of the perming solution open.

After passing through mixer 48 and optometer 49, as well as heating means 41, the mixture is supplied to curlers 2 and subsequently to optometer 52. If optomer 52 establishes the desired cloudiness, then by means of microprocessor 54 solenoid valves 45,46 and 57 are closed and solenoid valves 56 and 58 opened. The hair treatment solution is now pumped in circuit by the two pumps 37,38.

If optometer 49 detects an incorrect mixing ratio of the two components I and II of the perming solution, then solenoid valves 58,59 and 60 are switched over in such a way that valves 58 and 59 close and valve 60 opens. The solution is then fed to collecting container 53. Simultaneously, by means of pumps 37,38, the quantity of components I and II corresponding to the removed quantity are taken containers 39 and 40. If optometer 49 detects a correct mixing ratio, then solenoid valves 58,59 and 60 are switched to normal position.

Following the desired treatment time with the perming solution, it is supplied by means of the corresponding positioning of solenoid valves 56,57 to the collecting containers 53 and simultaneously by a corresponding positioning of the solenoid valves pumps 37,38 remove liquid, e.g. water from container 44 in order to rinse out the perming solution from hoselines 35 and curlers 2. In place of a perming solution comprising the two components I and II, it is possible to use a single-component perming solution, which is e.g. taken from container 41 and is also rinsed out at the end of the necessary action period. Following rinsing the hair is fixed, fixing fluid being taken from the container 42. This is followed by a further rinsing with water, the solenoid valves being switched into the corresponding position. Finally, from container 43 is taken a care or medical lotion, which is supplied to the curlers.

Water is then taken from container 44 for the final rinsing of the hair. The used and not re-usable hair treatment solutions are collected in collecting containers 53.

In the case of a fault or disturbance to the operation of the supply and control apparatus 34, e.g. in the case of a stoppage of the otherwise always simultaneously operating pumps 37,38 due to a power cut, it is possible to switch to manual operation, so that there is no damage to the hair through the treatment solution. Microprocessor 54 and the control elements can remain in operation by means of a battery cell.

What is claimed is:

1. An apparatus for hair cosmetic treatment, particularly for producing permanent waves, with at least one curler having a substantially rotationally symmetrical body for curling the hair, a jacket which can be placed on the body, embraces the curl and forms a gap between it and the body, said jacket being formed from two part cylindrical shells, which are provided with at least two contiguous longitudinal edges with seals and are held by means of spring tension in a closed position engaging the body, the jacket having an opening for the supply of liquid hair treatment agents and the body has transverse ducts for introducing said agents into the curl, wherein the jacket is formed from two semicylindrical shells completely surrounding the body, having on one end face a radially oriented feed opening, on the other end face a radially oriented discharge opening with in each case one line connection and on both end faces, outside the feed and discharge openings, engage on the body, wherein in each case one transverse duct is connected in the body to the feed and discharge opening and wherein, at least on their longitudinal edges with the seals, the shells can be additionally sealed by an applicable sealing compound.

2. An apparatus according to claim 1, wherein on both end faces a further sealing ring is provided within the supply and discharge opening and wherein the transverse ducts issue on the one hand in the space between the sealing rings and on the other in the space between the jacket and the body.

3. An apparatus, particularly according to one of claims 1 or 2, wherein a U-shaped clamping device comprising two parallel legs interconnected by means of a bend and producing the spring tension is provided, the bend being constructed as a receptable partly engaging round the ends of the half-shells and the free ends of the parallel legs can be moved towards one another and are resiliently lockable to one another.

4. An apparatus according to claim 3, wherein the free ends of the parallel legs of the clamping device are bent towards one another and the bent portions overlap and have a tooth system enabling them to be locked together.

5. An apparatus according to claim 4, wherein the tooth system is constructed as a sawtooth system.

6. An apparatus according to claim 3, wherein in each case one clamping device is provided on the ends of both half-shells.

7. An apparatus according to claim 3, wherein the clamping devices are arranged in such a way that the separating plane of the half-shells is oriented substantially parallel to the legs of the clamping device.

8. An apparatus according to claim 3, wherein the legs of the clamping device are shaped on the ends of the half-shells and the half-shells are constructed so as to be hookable together on the side facing the legs.

9. An apparatus according to claim 1, wherein the body and the jacket have a vicinity of the end faces a conically tapering portion and then an external cylindrical portion, which at the jacket serves as a seat for the clamping device.

10. An apparatus according to claim 1, wherein the line connections of the supply and discharge opening are formed by radial hose nipples mounted on the jacket.

11. An apparatus according to claim 1, wherein the supply and discharge openings for the liquid hair treatment solution are provided in the vicinity of the conically tapering portions on the jacket.

12. An apparatus according to claim 1, wherein the outside of the body and/or the inside of the jacket are provided with transverse and/or longitudinal grooves.

13. An apparatus according to claim 1, wherein the shells are given a greater wall thickness in the vicinity of the longitudinal edges.

14. An apparatus according to claim 1, wherein the longitudinal edges of the half-shells are inclined by approximately 45° to the diametral plane.

15. An apparatus according to claim 1, wherein the body is constructed with at least one wing axially arranged on the side and projecting over the jacket.

16. An apparatus according to claim 1, wherein the sealing compound includes a waterproof emulsion.

17. An apparatus according to claim 1, wherein the sealing compound is hydrophobic.

18. An apparatus according to claim 1, wherein it comprises a water-in-oil emulsion.

19. An apparatus according to claim 1, wherein a plurality of curlers are interconnected by hoselines and via highspeed couplings, as well as being connected to a supply and control apparatus with a microprocessor.

20. An apparatus according to claim 19, wherein the supply and control apparatus for the purpose of transporting the hair treatment solution is provided with a mixer for mixing the components of the perming solution and a heating means for heating the same.

21. An apparatus according to one of claims 19 or 20, wherein for monitoring or adjusting the mixing ratio of the components of the perming solution pH-meters, flowmeters, turbidimeters (optometers) or the like are provided.

22. An apparatus according to claim 21, wherein a turbidimeter (optometer) is provided behind the curlers in the flow direction.

23. An apparatus according to claim 19, wherein the supply and control apparatus includes containers for different hair treatment solutions.

24. An apparatus according to claim 23, wherein collecting containers are provided for spent or used treatment solutions.

25. An apparatus according to claim 24, wherein the pumps can be switched over to manual operation.

* * * * *